United States Patent [19]

Reynolds

[11] 4,220,127

[45] Sep. 2, 1980

[54] FUEL VAPORIZER

[75] Inventor: Alfred L. Reynolds, Plainview, Tex.

[73] Assignee: James P. Federer, Cheyenne, Wyo.

[21] Appl. No.: 846,401

[22] Filed: Oct. 28, 1977

[51] Int. Cl.[3] ..... F02M 17/22

[52] U.S. Cl. ..... 123/522; 123/573; 261/121 B

[58] Field of Search ..... 123/133, 134, 179 G, 123/1 A, 119 B, 136; 261/119 A, 121 R, 121 A, 121 B

[56] References Cited

U.S. PATENT DOCUMENTS

| | | | |
|---|---|---|---|
| 1,051,122 | 1/1913 | Krayer | 123/134 |
| 2,315,881 | 4/1943 | Thomas | 123/133 |
| 2,625,142 | 1/1953 | Chambers | 123/134 |
| 2,742,886 | 4/1956 | McPherson | 123/133 |
| 3,713,429 | 1/1973 | Dwyre | 123/134 |
| 3,749,376 | 7/1973 | Alm | 123/134 |
| 3,800,533 | 4/1974 | Zankowski | 123/134 |
| 3,834,365 | 9/1974 | Ussery | 123/119 B |
| 4,000,727 | 1/1977 | Walker | 123/119 B |
| 4,031,864 | 6/1977 | Crothers | 123/1 A |
| 4,031,874 | 6/1977 | Alwine | 123/134 |

*Primary Examiner*—Ronald H. Lazarus
*Attorney, Agent, or Firm*—Wendell Coffee

[57] ABSTRACT

Air is bubbled through a preset level of fuel in a vaporization chamber, thus forming a vaporized fuel-air mixture. The vaporized fuel-air mixture is supplied to the carburetor through a vapor conduit from the crankcase. Each time the engine is started, a drop of additive is inserted. Each time the engine is stopped the fuel is drained from the vaporization chamber.

13 Claims, 5 Drawing Figures

FUEL VAPORIZER

BACKGROUND OF THE INVENTION (1) Field of the Invention

This invention relates to spark ignition, internal combustion engine and more particularly to furnishing the proper fuel-air mixture thereto.

(2) Description of Conventional Automobile

Conventional automobiles are now made with carburetors connected to manifolds which are connected to cylinders of spark ignition engines. Conventionally, the carburetor has a choke valve, a venturi area and a throttle valve. Fuel is pumped from a fuel tank through a float valve to the venturi. The idle speed of the automobile is adjusted by the minimum opening of the throttle valve.

To decrease air pollution, normally, the carburetor between the throttle valve and the manifold is connected by a vapor conduit to the crankcase. By the term "crankcase" I mean the area connected to the lubricating part of the engine which may be other than the crankcase itself, but generally this part of the engine is characterized by the term "crankcase."

At normal engine speeds with the throttle valve open a normal amount, a proper amount of air is drawn from the crankcase and, therefore, the carburetor with its normal setting works quite well. However, at speeds where the throttle is nearly closed, as at idle or very low speed driving, a very low pressure or high vacuum exists on the manifold so that a large amount of air is drawn in through the vapor conduit from the crankcase. This condition makes regulation of the correct fuel-air ratio very difficult at low speeds, such as are encountered in city driving.

SUMMARY OF THE INVENTION (1) New and Different Function

This problem has been solved by providing a fuel vaporizer which includes a vaporization chamber having liquid fuel in the bottom and having a bubble tube to bubble air through the fuel, forming a vaporized fuel-air mixture. This vaporized fuel-air mixture is connected to the vapor conduit. Therefore, when there is a very high vacuum or very low pressure on the manifold, as at idling, instead of the air being pulled in from the crankcase, all or a portion is pulled in from the vaporization chamber which yields a better fuel-air ratio entering the cylinders.

Also, this additional fuel is completely vaporized. In many driving situations, such as city driving, much of the time the automobile engine is either idling or driving at slow speeds; therefore, this vaporized fuel-air mixture is beneficial in increasing gas mileage in these situations.

The vaporization chamber itself is simply a chamber having a float valve at the bottom, a tube extending from the outside to near the bottom and a check valve at the top to prevent any difficulties resulting from the engine back-firing through the carburetor. Yet, with this simple arrangement connected in the above described manner, great fuel economies are realized.

In addition, there are certain additives that are beneficially added to the engine in very minute quantities and particularly when the engine is first started. I provide the addition of these additives by putting a small reservoir adjacent to the top of the bubble tube so that each time the engine is started a drop of the additive is added to the vaporization chamber. This reservoir is arranged similar to a container for watering pets such as for gerbils or hamsters so that another drop is not added until the engine is stopped and then restored, again producing a slight vacuum at this point.

With fuel being vaporized out of the vaporization chamber, there is difficulty with build-up of the heavier factions of the fuel in the vaporization chamber which are not readily vaporized. If these are not periodically drained a problem exists with a build-up of lacquer or varnish in the bottom of the chamber. I have solved this problem by providing a drain from the bottom of the chamber to the fuel line with a check valve. Normally, there will be a greater vacuum on the fuel chamber than on the fuel line, and therefore, a check valve prevents flow of fuel from the fuel line into the vaporization chamber. However, when the engine is stopped and there is no reduced pressure on the vaporization chamber the excess fuel in the bottom of the chamber readily flows back into the fuel line.

Thus, the function of the combination is far greater than the sum of the functions of the individual parts.

(2) Objects of this Invention

An object of this invention is to vaporize fuel.

Another object is to improve the performance of spark ignition automobile engines.

Further objects are to achieve the above with a device that is sturdy, compact, durable, lightweight, simple, safe, efficient, versatile, energy conserving, ecologically compatible and reliable, yet inexpensive and easy to manufacture, install, adjust, operate and maintain.

Other objects are to achieve the above with a method that is versatile, energy conserving, ecologically compatible, rapid, efficient and inexpensive, and does not require skilled people to install, adjust, operate and maintain.

The specific nature of the invention, as well as other objects, uses, and advantages thereof, will clearly appear from the following description and from the accompanying drawing, the different view of which are not to the same scale.

DESCRIPTION OF THE PREFERRED EMBODIMENT

Figure 1:
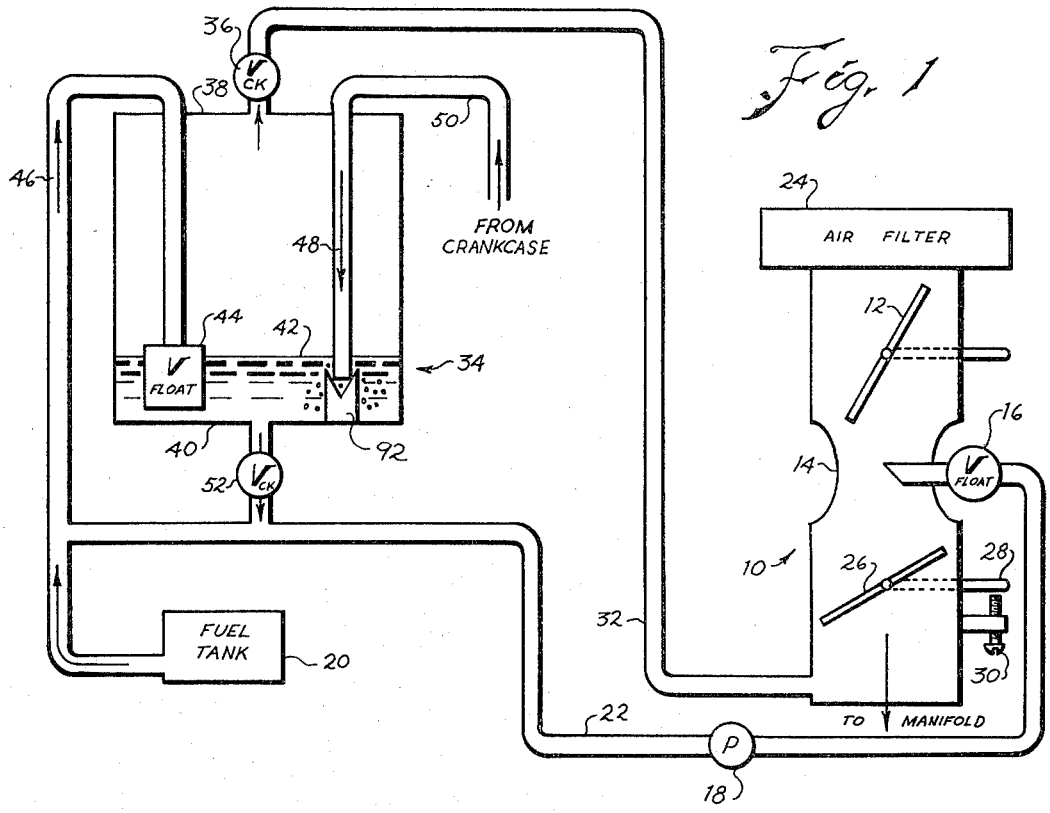
FIG. 1 is a schematic representation of an embodiment of this invention as connected to a conventional automobile engine.

Referring to the drawing, particularly FIG. 1, there may be seen certain elements from a conventional spark ignition automobile engine. Specifically, there may be seen carburetor 10 having choke valve 12 with its operating lever and venturi 14 with its associated carburetor float valve 16. Fuel pump 18 pumps fuel from fuel tank 20 through main fuel line 22 to the float valve 16 where it is made available to the venturi 14 of the carburetor 10. Air filter 24 filters dust and other particles from the air before it is sucked into the carburetor 10.

The engine speed is normally controlled by throttle valve 26. Control lever 28 is connected to the throttle valve 26. The control lever 28 is connected to other apparatus (not shown) such as an accelerator pedal. Normally, the minimum closure of the throttle valve 26 is controlled by an idle adjustment which is here represented in simplified form as idle adjustment screw 30 which is screwed through an ear on the carburetor to abut against the control lever 28 of the throttle valve 26. Of course, the carburetor 10 is connected so that the fuel-air mixture as produced by the carburetor is received by the manifold of the engine where it is conveyed to the cylinders to be burned.

Normally vapor conduit 32 connects the crankcase of the engine to the carburetor 10 at a point on the carburetor between the throttle valve 26 and the manifold.

It will be understood that the elements as specifically described to this point are conventional to automobiles as manufactured before my invention.

To this conventional automobile engine I have described, I install vaporization chamber 34. I have had good success having a vaporization chamber with a depth of about 17 cm. Specifically, the depth is from the bottom of check valve 36 at top 38 of the chamber 34 to bottom 40 of the chamber 34. The cross-sectional area, which would be the area of liquid fuel level 42 in the vaporization chamber 34, is about 150 $cm^2$. Vaporization float valve 44 is connected by vaporization fuel line 46 to the main fuel line 22 between the pump 18 and the tank 20. The vaporization float valve 44 is placed in the vaporization chamber 34 so that the fuel level 42 is about 3 cm from the bottom 40 of the vaporization chamber.

Bubble tube 44 extends from the top of the vaporization chamber 34 to near the bottom 40. I have had good success using bubble tubes having an inside diameter of about 6 mm and which terminate about 2 cm from the bottom 40. Therefore, the bottom of the bubble tube 48 will be submerged in about 1 cm of liquid fuel.

The vaporization chamber 34 is conveniently mounted by flanges along the side of the chamber (not shown for simplicity of the drawing) to a wall of the engine compartment of the automobile. In this area, it will receive a certain amount of heat from the engine, but other than the heat it receives from the engine, the chamber is not otherwise heated.

The operation will be apparent. When the automobile is idling, there will be a strong vacuum on the manifold and, therefore, upon the vapor conduit 32. Air will flow downward through the bubble tube 48 and will bubble through the fuel in the bottom of the vaporization chamber 34, fully vaporizing the fuel. The vaporized fuel-air mixture will be sucked through the check valve 36 and the vapor conduit 32 into the manifold below the throttle valve 22. The top of the bubble tube 48 is connected by crankcase vapor line 50 to the crankcase so that certain fumes and air from the crankcase will be carried through the vaporization chamber 34 to the carburetor 10 or the manifold.

This fuel-air mixture from the vaporization chamber 34 together with what is normally supplied through the carburetor venturi 14 will provide a proper fuel-air mixture at idling speeds. Also, it will be understood that when the automobile is operating at higher speeds and, therefore, with the throttle valve 26 open wider, there will be a lower pressure upon the manifold even though the engine is running faster. At normal speeds there will be less vacuum upon the vapor conduit 32 and, therefore, less vaporized fuel-air mixture will be sucked in from the vaporization chamber 34.

The length and diameter of the bubble tube 48 will be the primary control of the amount of air sucked in through the vaporization chamber, however, check valve 36 will regulate it to some extent. The dimensions of the preferred size of the bubble tube were previously given and I prefer to use a vapor conduit 32 having an internal diameter of about 10 mm. Stated otherwise, the proper maximum internal cross-sectional area is about 75 $cm^2$.

It is not desirable to have an extremely high vacuum upon the vaporization chamber 34 because with an extremely high vacuum it is necessary to make the chamber sufficiently strong to withstand the atmospheric pressure around it. I have had success with the fuel vaporizer constructed as described. There is always sufficient vacuum or reduced pressure within the vaporization chamber 34 to pull fuel into the vaporization chamber from the fuel line between the fuel tank 20 and the pump 18. Having the fuel vacuum fed into the vaporization chamber 34 prevents an overflow of fuel within it and reduces the strain upon the float valve 44 which regulates the fuel level.

Drain check valve 52 is provided to prevent stale fuel from accumulating in the vaporization chamber. The check valve 52 will prevent build-up of heavier factions in the fuel. It will be understood that the lighter factions of the fuel will vaporize first from the vaporization chamber 34. If the heavier factions of the fuel are not dispose of at regular intervals there will be undesirable build-up of them in the vaporization chamber 34. The check valve 52 connects the bottom 40 of the vaporization chamber to the fuel tank 20. Normally, when the engine is running there will be a higher vacuum within the vaporization chamber 34 and, therefore, there will be no fuel flow through the check valve 52 inasmuch as it permits fuel to run from the vaporization chamber only. However, any time the engine is stopped there will be no vacuum on the vapor conduit 32 and, therefore, no vacuum upon the vaporization chamber 34. Under such condition the fuel within the vaporization chamber 34 will drain by gravity into the fuel tank. As soon as the automobile is started a fresh charge of fuel will be quickly brought into the vaporization chamber.

The submergence of the end of the bubble tube 48 in the fuel will regulate the amount of fuel vaporized and will have an influence on the amount of fuel-air mixture sucked into the engine from the vaporization chamber 34. As previously stated, I prefer to have the bubble tube 48 submerged about 1 cm.

Figure 2:
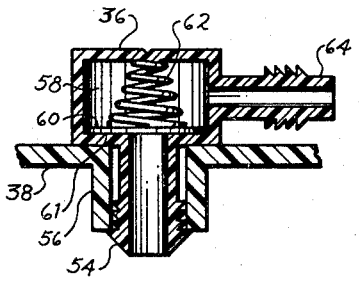
FIG. 2 is a sectional view of the check valve on the vapor outlet of the vaporization chamber.

FIG. 2 shows details of the construction of the check valve 36. As seen, it has spear 54 adapted to be pierced into short tube 56 integral with the top 38 of the vaporization chamber 34, which is made of suitable "synthetic" plastic material. The check valve 36 has spring cavity 58. The bottom of the cavity 58 forms valve seat 61. Disc valve 60 is held securely upon the seat 61 by spring 62 which extends to the dimpled top of the check valve 36. Nipple 64 communicates to the spring cavity 58 and provides for connection to the line which connects to the carburetor 10.

It will be understood that the spring 62 is a very light spring. Therefore, it is not intended that there be any pressure differential across the check valve 36. The spring 62 is meant merely to insure that the valve disc 60 is seated properly on the seat 61 should there be back pressure for any reason from the carburetor 10.

Figure 3:
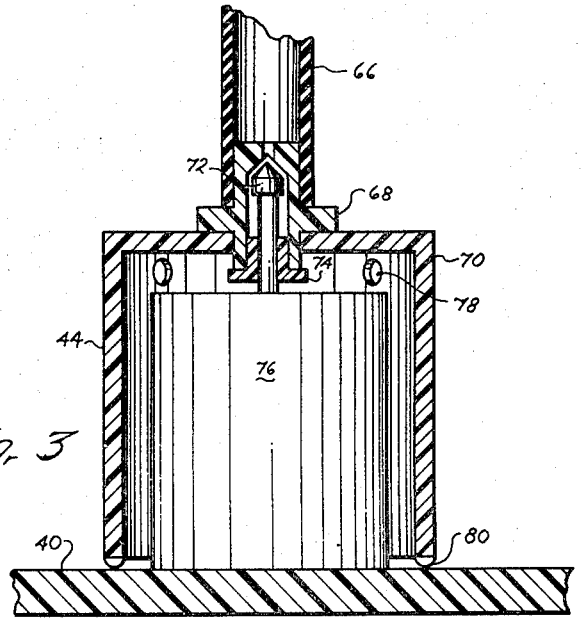
FIG. 3 is a sectional view of the float valve in the vaporization chamber.

Details of the float valve 44 are shown in FIG. 3. The float valve is suspended by rigid tube 66 which extends from the top 38 of the vaporizer chamber to the desired level. Valve seat member 68 is telescoped into the end of the tube 66. A small opening in the top of the spring cavity member 58 provides the valve seat for needle valve member 72. A flange limits the insertion of the member 68 into the tube 66 and also forms a stop for cage 70. The needle valve 72 has grooves along its sides to allow the fuel which passes through the hole in the top of the member 68 to pass through and out within grooves along the outside of retaining member or guide 74. The guide 74 acts as a bushing to guide the tail of the valve 72. The tail of the valve 72 extends down so that float 76 within the cage 70 rises and pushes against the tail, thus closing the valve 72 against the valve seat member 68.

The cage 70 has apertures 78 therethrough to permit the free flow of fuel. Nipples 80 on the bottom of the cage 70 position the bottom of the cage from the bottom 40 of the vaporization chamber 34. Therefore, it may be seen that float valve 44 will always maintain the fuel within the vaporization chamber at the preset fuel level 42.

Figure 4:
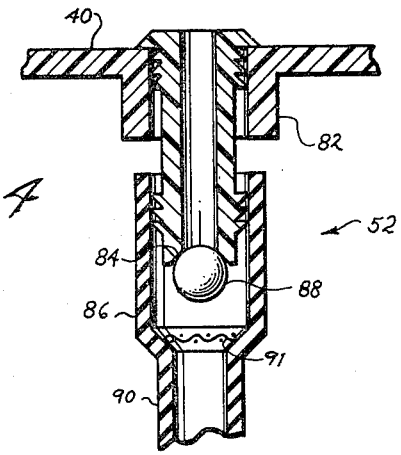
FIG. 4 is a sectional view of the drain valve from the vaporization chamber.

FIG. 4 shows the details of the drain check valve 52. Short tube 82 integral with the bottom 40 of the vaporization chamber 34 extends downward. Top valve seat 84 is connected to the short tube 82. Valve chamber 86 is threaded to the valve seat 84. Light ball 88 is contained within the valve chamber 86. The bottom of the valve chamber 86 has a suitable nipple. Return fuel tube 90 is connected from the nipple on the chamber 86 to the fuel tank 20. Screen 91 retains the ball 88. It should be understood that the ball 88 will rise at any attempted flow of fuel from the fuel line 22 into the vaporization chamber 34. However, if there is no vacuum upon the vaporization chamber the fuel readily flows from the vaporization chamber by gravity into the fuel line 22.

The vaporization chamber 34 itself is made in two sections being divided by a horizontal parting line about the middle. I prefer to make it in two halves and then weld the two halves together by ulrasonic weldings. It should be understood, according to present methods of construction, that half of the original tube 66 is cast into the top half of the vaporization chamber as it is formed of plastic and the bottom half includes clip 92 which holds the bottom of the bubble tube 48 in place.

It will be understood that the vaporization chamber is very easily installed upon any existing automobile and that besides attaching the chamber to some convenient support by the flanges (not shown in the drawing) on the chamber, all that is necessary is to cut the existing line from the crankcase to the bottom of the carburetor so that half of the existing line forms the crankcase vapor line 50 and the other half forms the vapor conduit 32. After the line is cut, thus forming the two lines they are connected to the vaporization chamber as shown. One or the other may be extended by an extension as needed. Also, of course, it will be necessary to install the fuel line 46 and the drain line from the drain check valve 52. There is no adjustment necessary on the automobile except to adjust idle adjustment screw 26 so the automobile idles at the proper speed after installation of the vaporization chamber.

Figure 5:
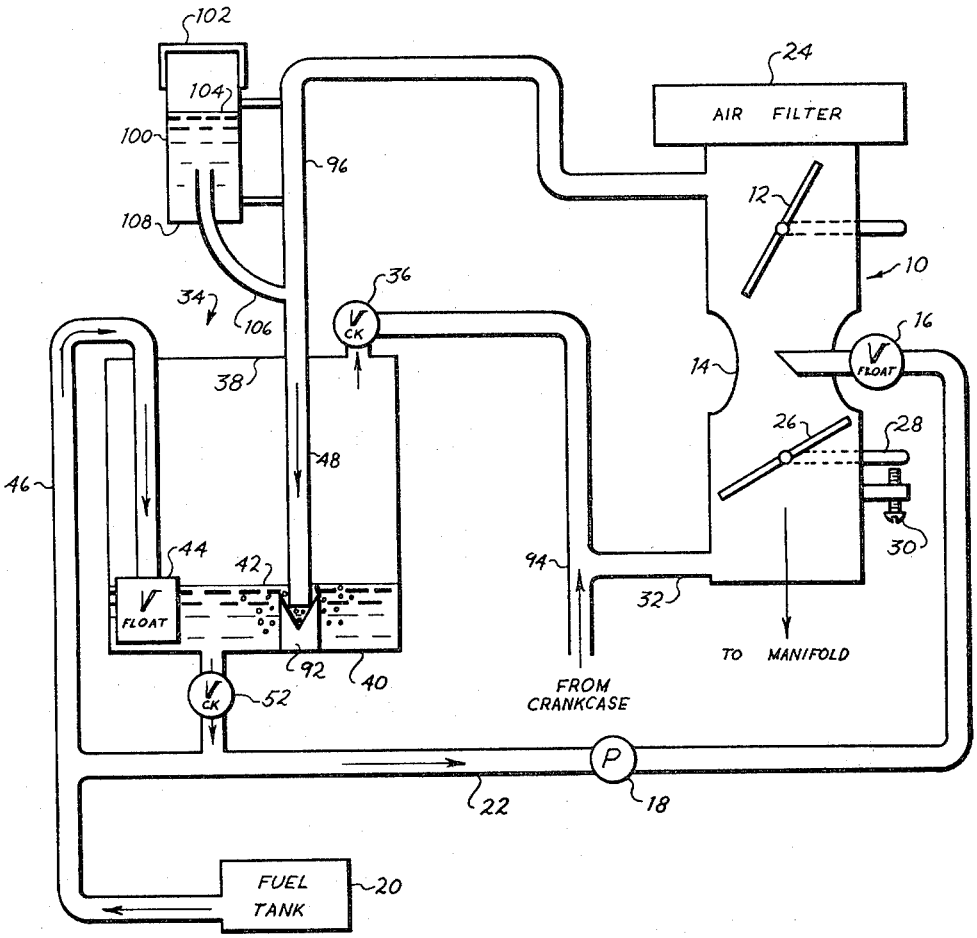
FIG. 5 is a sectional view of a modified embodiment of this invention.

FIG. 5 shows a slightly different embodiment and also a means for adding a drop of additive each time the engine is started. Also, it shows many of the features of the first embodiment, specifically, it includes carburetor 10 having choke valve 12, venturi 14, float valve 16 is provided fuel by fuel pump 18 from the fuel tank 20 by fuel line 22. The air filter 24 provides clean air to the carburetor. Throttle valve 26 with lever 28 and set screw 30 function as before.

In this embodiment the vapor conduit 32 has tee 94 so that a portion of the air brought into the bottom of the carburetor comes from the crankcase and the other portion from the vaporization chamber 34. Also, the check valve 36 prevents any malfunction. The vaporization chamber has top 38 and bottom 40 with a normal fuel level 42 as controlled by float valve 44, which is supplied by fuel line 46. Bubble tube 46 in this embodiment is connected by an inlet line or air cleaner line 96 to within the air cleaner or air filter. Schematically it is shown at the top of the carburetor inasmuch as this is the functional equivalent of connection at that point. The drain check valve 52 functions as before.

Additive reservoir 100 is attached to the air cleaner line 96 also called the inlet line 96. The reservoir 100 has an air tight cap 102 to place additives 104 within the reservoir 100. Small additive tube 106 extends from bottom 108 of the reservoir into the reservoir above the bottom 108. The small additive tube 106 is connected to the air cleaner line 96 immediately above the bubble tube 48.

Analysis will show that each time the engine is started and that there is a slight vacuum produced on the bubble tube 48. A drop of additive 104 will then drip into the bubble tube 48 and be carried on into the fuel at the bottom of the vaporization chamber 34. However, additional additive will not flow from the reservoir 100 until the engine is stopped and there is no longer vacuum on the line 48. At the time an air bubble will flow from the bottom up into the additive reservoir 100 so that at the next time the engine is started another drop of additive will drop. This is quite similar to containers for watering pets, such as gerbils or hamsters.

Thus it may be seen that I have provided means for adding a drop of additive to the vaporization chamber each time the engine is started and not thereafter.

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | carburetor | 60 | disc, valve |
| 12 | choke valve | 61 | seat |
| 14 | venturi | 62 | spring |
| 16 | float valve, carbu. | 64 | nipple |
| 18 | fuel pump | 66 | tube |
| 20 | fuel tank | 68 | valve seat member |
| 22 | fuel line, main | 70 | cage |
| 24 | air filter | 72 | valve |
| 26 | throttle valve | 74 | guide |
| 28 | control lever | 76 | float |
| 30 | idle adjust screw | 78 | apertures |
| 32 | vapor conduit | 80 | nipples |
| 34 | vaporization chamber | 82 | tube |

-continued

| | | | |
|---|---|---|---|
| 36 | check valve | 84 | valve seat |
| 38 | top | 86 | valve chamber |
| 40 | bottom | 88 | ball |
| 42 | fuel level | 90 | return fuel tube |
| 44 | float valve, vap | 91 | screen |
| 46 | fuel line, vap | 92 | clip |
| 48 | bubble tube | 94 | tee |
| 50 | crank case vap line | 96 | A-C line |
| 52 | check valve, drain | 100 | reservoir |
| 54 | spear | 102 | cap |
| 56 | short tube | 104 | additive |
| 58 | spring cavity | 106 | add tube |

I claim as my invention:

1. In an automobile having a spark ignition engine, the improved structure comprising in combination:

a. a crankcase,
b. a manifold,
c. a carburetor on the manifold having
(i) a choke valve, and
(ii) a throttle valve,
d. an air cleaner on the carburetor,
e. a fuel tank,
f. a fuel line from the fuel tank to the carburetor,
g. a fuel pump in the fuel line,
h. a vaporization chamber having a top, a bottom, an interior and cross-sectional area of about 150 $cm^2$,
j. a float valve in the vaporization chamber including
(i) a rigid tube from the top of the chamber extending downward into the chamber,
(ii) a valve seat member telescoped into the rigid tube,
(iii) a needle valve telescoped within the valve seat member,
(iv) said needle valve having a tail which extends through a bushing on a bottom of the valve seat member,
(v) said valve seat member having a cage attached to a lower portion thereof,
(vi) nipples on a bottom of the cage bearing against the bottom of the vaporizer chamber,
(vii) a float in the cage so that a top of the float can push a bottom of the tail up to a seat in the valve member,
k. said rigid tube being connected to said fuel line between the fuel pump and fuel tank, whereby
m. said float valve providing means for maintaining a preset fuel level of about 3 cm of fuel in the vaporization chamber,
n. a bubble tube extending from the top of the chamber to about 2 cm above the bottom of the chamber which will be below the fuel level specified above,
o. said bubble tube having a maximum internal cross sectional area of about 75 sq mm,
p. said bubble tube having a length of about 15 cm,
q. a check valve at the top of the chamber,
r. said check valve having
(i) a valve seat communicating with the interior of the vaporization chamber,
(ii) a valve disc on a top of said valve seat,
(iii) a spring on a top of said valve disc,
(iv) said spring being within a portion of the check valve designated as a spring chamber, and
(v) a nipple fully connected to said spring chamber, and
s. a check valve line extending from the nipple to a connection with the carburetor between the throttle valve and manifold,
t. a drain valve including
(i) a drain valve seat in the bottom of the chamber,
(ii) a drain valve ball on the seat, and
(iii) a drain line from the drain valve to the fuel line between the pump and tank.

2. The invention as defined in claim 1 further comprising:

u. a crankcase vapor line connecting the crankcase to the top of the bubble tube so that fumes from the crankcase are pulled into the vaporization chamber.

3. The invention as defined in claim 1 further comprising:

u. an air cleaner line connecting from within an air cleaner to a top of the bubble tube,
v. a fuel additive reservoir
(i) attached to the air cleaner line, and
(ii) having a sealed cap on top, and
w. a small additive tube
(i) extending from the air cleaner line adjacent the bubble tube top to
(ii) within the reservoir a short distance above the bottom,
(iii) so that a small amount of additive is fed from the reservoir into the vaporization chamber each time the engine is started causing a reduced pressure on the air cleaner line.

4. In an automobile having a spark ignition engine, the improved structure comprising in combination:

a. a crankcase,
b. a manifold,
c. a carburetor on the manifold having
(i) a choke valve and
(ii) a throttle valve,
d. an air cleaner on the carburetor,
e. a fuel tank,
f. a fuel line from the tank to the carburetor,
g. a fuel pump in the fuel line,
h. a vaporization chamber having a top and bottom,
j. a float valve in the chamber connected to the fuel line to keep a preset level of fuel in the vaporization chamber,
k. a bubble tube extending from the top of the chamber to near the bottom of the chamber below the fuel level,
m. the top of the chamber connected to said carburetor between the throttle valve and manifold,
n. a drain line from the bottom of the vaporization chamber to the fuel line between the pump and tank, and
o. a drain check valve in said drain line forming means for preventing flow from the fuel line to the chamber.

5. The invention as defined in claim 4 further comprising:

o. an additive reservoir adjacent a top of the bubble tube,
p. feed means connecting the additive reservoir to the bubble tube for feeding a drop of additive from the reservoir to the bubble tube each time the engine is started.

6. The invention as defined in claim 4 with additional limitations of o. a vapor check valve at the top of the vaporization chamber, and
p. said vapor check valve is the means by which the chamber is connected to said carburetor, 7. The invention as defined in claim 6 with additional limitations of q. said vapor check valve including a valve seat connected to the top of the vaporization chamber, r. a valve disc on the top of said valve seat, and s. a spring on top of said valve disc.

8. The invention as defined in claim 7 further comprising:

t. a drain check valve in said drain line forming means for preventing flow from the fuel line to the chamber.

9. The invention as defined in claim 8 further comprising:

u. an additive reservoir adjacent a top of the bubble tube, v. feed means connecting the additive reservoir to the bubble tube for feeding a drop of additive from the reservoir to the bubble tube each time the engine is started.

10. The invention as defined in claim 8 further comprising:

u. a crankcase line connecting the crankcase to the top of the bubble tube.

11. The invention as defined in claim 8 wherein u. the bottom of the tube is about 2 cm from the bottom of the vaporization chamber, and v. the level of the fuel is about 3 cm above the bottom of the vaporization chamber.

12. The invention as defined in claim 11 wherein w. the vaporization chamber has a cross sectional area of about 150 $cm^2$ and has a depth of about 17 cm as measured from the bottom of the vaporization chamber to the bottom of the vaporized fuel-air outlet.

13. The invention as defined in claim 12 with an additional limitation of x. said bubble tube having a length of about 15 cm and an inside diameter of about 6 mm.

* * * * *